United States Patent [19]

Naumann

[11] Patent Number: 4,640,503

[45] Date of Patent: Feb. 3, 1987

[54] SHEET-SEPARATING AND CONVEYING SUCTION DEVICE

[75] Inventor: Reinhard Naumann, Delitzsch, German Democratic Rep.

[73] Assignee: VEB Kombinat Polygraph "Werner Lamberz" Leipzig, Leipzig, German Democratic Rep.

[21] Appl. No.: 697,118

[22] Filed: Jan. 30, 1985

[30] Foreign Application Priority Data

May 28, 1984 [DD] German Democratic Rep. ..... 2634154

[51] Int. Cl.[4] ..... B65H 3/08

[52] U.S. Cl. ..... 271/103; 271/90; 414/121; 92/85 B

[58] Field of Search ..... 271/103, 107, 108, 90; 414/121; 221/211; 92/85 B

[56] References Cited

U.S. PATENT DOCUMENTS

| | | | |
|---|---|---|---|
| 3,702,698 | 11/1972 | Schwebel | 271/103 |
| 3,834,558 | 9/1974 | Bru | 414/121 |
| 3,921,971 | 11/1975 | Vollrath | 271/103 |

FOREIGN PATENT DOCUMENTS

| | | | |
|---|---|---|---|
| 106018 | 8/1974 | German Democratic Rep. | . |
| 883579 | 11/1981 | U.S.S.R. | 92/85 B |

*Primary Examiner*—George E. A. Halvosa
*Assistant Examiner*—Matthew C. Graham
*Attorney, Agent, or Firm*—Michael J. Striker

[57] ABSTRACT

In a sheet-separating suction device a suction piston carrying a suction nozzle is reciprocally movable in a sleeve secured to a housing of the device. An additional piston having at least one throttle is reciprocally movable in another sleeve also secured to the housing. The additional piston cooperates with the suction piston so as to brake the latter in its movement to an initial position and prevent impacts of the suction piston against the wall of the housing.

5 Claims, 2 Drawing Figures

SHEET-SEPARATING AND CONVEYING SUCTION DEVICE

BACKGROUND OF THE INVENTION

The present invention pertains to suction devices for feeding sheets in sheet-separating or sheet-conveying apparatus, employed, for example in printing machines and operated in accordance with a pressure differential principle.

Known suction devices of this type can in principle differ from each other. For example, suction devices have been known, in which the initial position of the suction piston exactly corresponds to the position, which the suction piston takes, after the suction of a sheet thereby has been completed.

Due to the fact that the suction devices of this type are simple in construction and functionally reliable they have been widely employed in a sheet-feeding equipment. The structure and the function of such a suction device has been disclosed, for example in DD-PS No. 106,018.

Conventional suction devices of the foregoing type have the disadvantage that the suction piston, after the sheet has been sucked by a suction nozzle connected to the suction piston, that is at the end of the backward stroke of the piston in the direction of the housing end wall, is accelerated and strikes against this wall. This takes place due to a pneumatic pressure force, the value of which is determined by a pressure difference between the atmospheric pressure and under-pressure in the suction device and by the cross-section of the piston rod and also by the action of the force of the compression spring positioned in the suction device. An impact energy of the suction piston is therefore dependent upon a pressure force, a spring force, a piston mass and a piston stroke and increases with the stroke length increase. This takes place, particularly with greater suction strokes of the suction piston, which strokes are required during the separating the sheets from the stack having a buckled upper surface. The impact action of the suction piston due to its acceleration also leads to higher loading on the suction piston and the housing so that these structural components can be eventually damaged.

Furthermore, the impact occurring in the suction device is transmitted to the sheet-separating and sheet-conveying mechanisms and leads to an overloading and thus to an extensive wear of these mechanisms. The precision of the operation of the sheet-separating and conveying devices is negatively affected because the impacts occurring in these mechanisms cause vibrations. To avoid at least some of the above described negative effects it has been suggested until now to make the housing and the sheet-separating and sheet-conveying mechanisms of greater dimensions, which of course has involved a higher material consumption and also caused greater mass forces in the mechanisms of the sheet-separating device so that its ability to take loads has been limited.

SUMMARY OF THE INVENTION

It is an object of the present invention to overcome the above disadvantages of conventional suction devices of the type under discussion.

It is another object of this invention to increase the efficiency of the sheet-separating and sheet-conveying mechanisms and to decrease a material consumption.

These and other objects of the present invention are attained by a sheet-separating and conveying suction device, comprising a housing, a sleeve positioned in said housing and secured thereto, a suction piston having a hollow piston rod carrying a suction nozzle and being reciprocally movable upwardly and downwardly in said sleeve between an initial and end position; a spring-biasing said piston to the initial position in said housing, in which said suction nozzle is remote from a sheet to be sucked from a stack, said housing having a peripheral wall and an end wall, said suction piston with said hollow piston rod and said peripheral wall and said sleeve defining one cylinder chamber in said housing while said peripheral wall with said end wall defining another cylinder chamber in said housing; throttle means for connecting said one cylinder chamber and said another cylinder chamber with each other; and braking means for retarding the movement of said suction piston towards its initial position.

Due to the provision of the braking means the impact of the suction piston against the wall of the housing is eliminated whereby all the negative effects of the conventional suction devices are be overcome.

The braking means may include an additional suction piston having a piston rod, an additional sleeve secured to said housing, said additional suction piston being slidably movable in said additional sleeve between said end wall and said first mentioned suction piston, the piston rod of said additional piston and said additional sleeve defining a first intermediate cylinder chamber while the piston rod of said additional piston and said peripheral wall defining a second intermediate cylinder chamber, said throttle means connecting said first intermediate cylinder chamber with said another cylinder chamber and said second intermediate cylinder chamber, the piston rod of the first mentioned suction piston having a bore which opens into said second intermediate cylinder chamber.

The first mentioned sleeve and said additional sleeve may be secured to said housing by screws.

The throttle means may include a first throttle which is formed by an annular gap provided between said peripheral wall of said housing and a periphery of said additional suction piston, said first throttle connecting said first intermediate cylinder chamber with said another cylinder chamber, said additional sleeve having a supporting surface, said first throttle being closable when said additional suction piston abuts against said supporting surface.

The throttle means may further include a second throttle which is formed by a through bore in said additional sleeve, said second throttle connecting said first intermediate cylinder chamber with said second intermediate cylinder chamber.

The suction device may further comprise stops on said end wall, said additional suction piston abutting against said stops in said initial position of said first mentioned suction piston, said additional suction piston and said stops being formed so that minimal sufficient volumes of said another chamber and said first intermediate cylinder chamber in said initial position are ensured.

Upon the loading of the suction device with suction air a pressure differential, acting on the suction piston, will move the suction piston from its initial position towards the stack of sheets. After closing the suction nozzle with the sheet sucked off the stack vacuum builts up in the lower or the above mentioned one cylinder chamber which is in communication with the central bore of the hollow piston of the main suction piston. Thereby the uppermost sheet is sucked by the suction nozzle and the suction piston moves in the direction of its initial position. Simultaneously vacuum in the lower cylinder chamber acts on the cross-section of the piston rod of the additional suction piston so that the latter moves towards the main suction piston. Due to the provision of the throttle means an approximately atmospheric pressure remains in the beginning in the cylinder chambers corresponding to the additional suction piston.

When the additional suction piston reaches the supporting surface of the additional sleeve approximately atmospheric pressure prevails in the upper cylinder chamber because of closing of the throttle means whereas in the first intermediate cylinder chamber the pressure is reduced via the throttle means. A resulting pressure differential, acting on the suction pistons, generates force components which counteract to the movement of the main suction piston. If the main suction piston comes into contact with the piston rod of the additional piston the main suction piston will be retarded by this force action. Then a further increase in the pressure differential and thus a braking action will result during the initial retarding phase via a quick piston movement. After the retardation, the main suction piston and the additional suction piston move with a lower speed unless they reach their initial position where a pressure equalization takes place in all the cylinder chamber by the throttle means.

The advantage of the sheet-separating device of the present invention resides in that, due to the provision of the braking means, impacts of the suction piston against the housing wall are avoided so that no overloads of these components occur and reactive effects on the sheet-separating and conveying mechanisms are avoided.

The simple construction of the braking means ensures reliable functions of the device without, however requiring high costs. Additional control devices are not necessary. The braking means of this invention ensures that the suction piston takes its initial position at due time independently from its kinetic energy before the retardation or independently from the magnitude of its suction stroke.

A further advantage of the braking means according to this invention resides in that the differential pressure is built up depending on the suction stroke and the underpressure in the suction device so that braking capabilities correspond somewhat to kinetic energy of the suction piston and thereby the shortest possible braking time period is warranted. Therefore the output of the suction device, that is the number of possible work cycles per time unit, can be increased, without disturbing the operation of the suction device.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DESCRIPTION OF THE PREFERRED EMBODIMENTS

Figure 1:
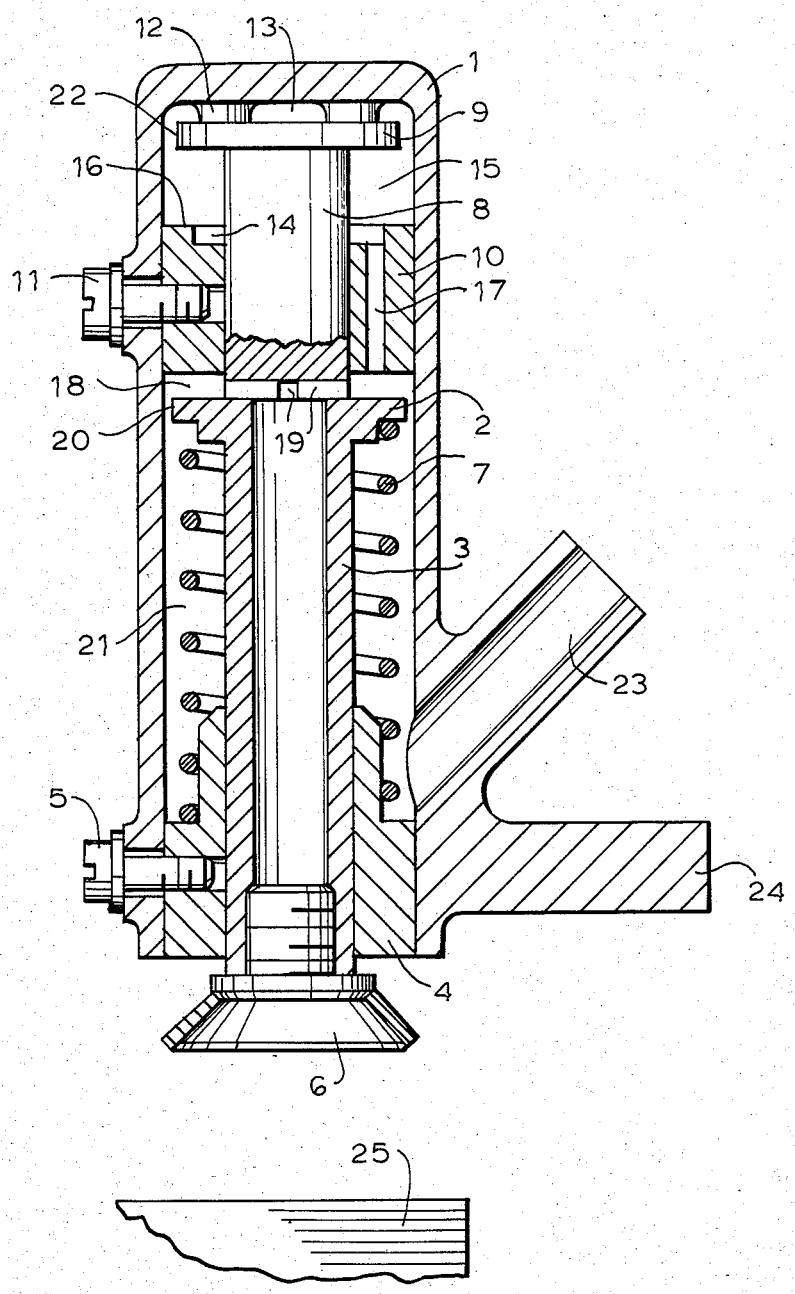
FIG. 1 is a sectional view through a suction device with the suction piston shown in its initial position.

Referring now to the drawings in detail, a suction piston 2 is postioned in a housing 1 of the suction device. A hollow piston rod 3 of piston 2 is slidably guided in a sleeve 4 which is secured in housing 1 by means of at least one screw 5. Piston rod 3 carries an inserted therein suction nozzle 6 which is connected to the lower end of the piston rod 3. The suction piston 2 is held in its initial postion by a compression spring 7 which is supported on sleeve 4. Thereby the suction piston presses against a piston rod 8 of an additional piston 9 and holds thereby piston 9 in its initial position. Piston 9 is, by means of its piston rod 8, slidably guided in an upper sleeve 10. The latter is connected to housing 1 by means of at least one screw 11 analogously to the lower sleeve 4. This type of connection ensures that the suction device can be easily dismantled, for example for cleaning.

Piston 9 in its initial position is supported against burl-like stops 12 formed on the upper wall of housing 1. These birl-shaped stops 12 ensure that an upper cylinder chamber 13 has yet a sufficient volume when the piston 9 is in its end position.

An annular recess 14 is formed at the side of the sleeve 10, facing the piston 9. Recess 14 ensures a predeterminal minimal volume of a first intermediate cylinder chamber 15 when the piston 9 abuts against a supporting surface 16 of the sleeve 10. A throttle bore 17 is formed in the sleeve 10. This throttle bore connects a second intermediate cylinder chamber 18 with the cylinder chamber 15 and opens into the annular recess 14.

The length of the piston rod 8 of piston 9 is selected so that the piston rod 8, upon striking the piston 9 against the stops 12, extends beyond sleeve 10 into the cylinder chamber 18. Overflow passages 19 are formed in the lower end face of the piston rod 8, these passages being so arranged that, upon contacting with the suction piston 2, a connection takes place between the second intermediate cylinder chamber 18 and the central bore of piston rod 3 of suction piston 2.

The diameter of the suction piston 2 in relation to the inner wall of housing 1 is selected so that an annular gap 20, forming a throttle, is provided, through which the cylinder chamber 18 is in communication with the lower cylinder chamber 21.

A further annular gap, forming another throttle 22 (which is shown in the drawing on an enlarged scale), is analogously provided between the piston 9 and the inner wall of housing 1. By means of the throttle 22 the cylinder chambers 15 and 13 are in communication with each other.

A suction air connection 23, opening into the lower cylinder chamber 21, is arranged in the housing 1 so that the suction piston 2 can move up to the upper edge of sleeve 4. A driving collar 24 is provided on the housing 1, this collar serving the purpose of connecting the suction device to the sheet-separating or sheet-conveying apparatus.

Before each working cycle of the suction device substantially atmospheric pressure prevails in all cylinder chambers 13, 15, 18 and 21. If the suction air connection 23 is connected by a control valve with a suction air source an underpressure will then occur in the lower cylinder chamber 21. Since the second intermediate cylinder chamber 18 is connected, via the hollow piston rod 3 and yet un-closed suction nozzle 6, with external air a pressure differential is exerted on the suction piston 2, which pressure differential would effect the movement of the suction piston 2 towards a sheet stack 25, against the force of the compression spring 7. Upon setting up the suction nozzle 6 on the stack 25 the connection of the cylinder chamber 18 with external air will be interrupted and under-pressure, by which sheet 26 will be sucked off the stack to the nozzle 6, will occur in the cylinder chamber 18 due to the annular gap forming the throttle 20. The pressure compensation in the cylinder chambers 21 and 18 will effect a pressure differential between the outer pressure and the underpressure in this portion of the suction device; this pressure differential will effect the movement of the suction piston 2, with the interposition of the compression spring 7, to its initial position.

Simultaneously with building-up of the underpressure in the cylinder chamber 18 piston 9 is moved by the suction force which acts on the cross-section of its piston rod 8 in the direction of the supporting surface 16 of the sleeve 10. The throttle 22 and the throttle bore 17 cause that the outer pressure at this stage, as before the switching-on the suction device, remains substantially unchanged in the first intermediate cylinder chamber 15 and the upper cylinder chamber 13.

Figure 2:
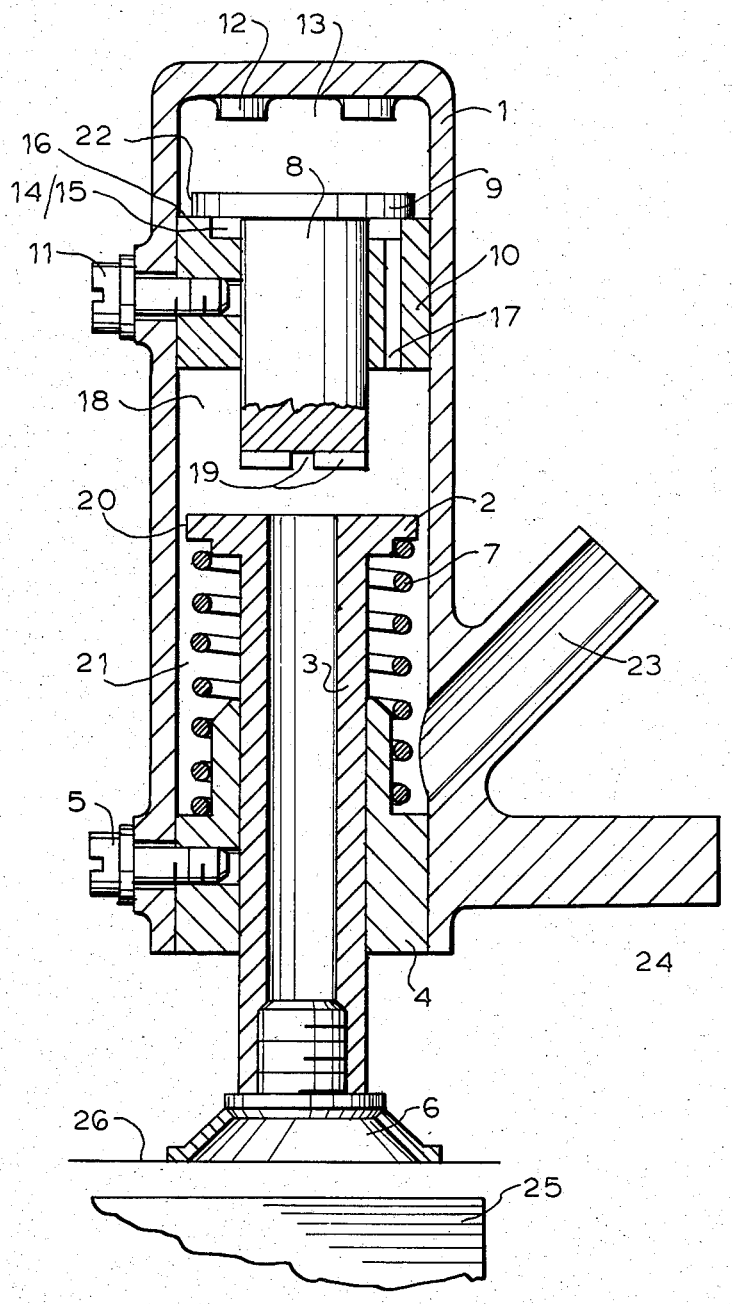
FIG. 2 is a sectional view of the device of FIG. 1 with the suction piston is shown in the position after the suction of a sheet from the stack.

After abutting the piston 9 abuts against the supporting surface of sleeve 10 the throttle 22 is closed so that the pressure in the upper cylinder chamber 13 remains the same while an underpressure develops in the annular recess 14 via the throttle bore 17. The positions of pistons 2 and 9 in the sheet-separating and/or conveying suction device at this point are illustrated in FIG. 2.

If the suction piston 2, which, through the end face of the rod 8 of piston 9, interrupted by the overflow passages 19, causes a pressure difference acting on the piston 9 a counter force exerts, which brakes the suction piston 2 in its movement. With this temporarily occurring braking process a counter pressure of piston 9 effects the increase in the pressure differential; then the reduction of the volume in the upper cylinder chamber 13 leads to a pressure increase in this chamber, and the increase of the volume in the first intermediate chamber 15 causes the increase of underpressure in this chamber. This means that firstly in accordance with retarding or braking of the piston a pressure equilization results through the throttle bore 17 and the annular gap or throttle 22, so that the suction piston 2 presses piston 9 with an insignificant speed up to its abutment against stops 12. The time period of the retardation and the time period of the movement of the pistons to the initial positions are extremely short as compared to the overall period of time of the suction process; moreover, these processes do not negatively affect the loading ability of the suction device.

If the suction device, after the sheet separation or after the sheet conveying, is vented the outer pressure occurs in the cylinder chambers 15 and 13 through the throttle bore 17 and annular gap-throttle 22 so that the sheet-separating and/or sheet-conveying suction device is ready for a new work cycle.

It will be understood that each of the elements described above, or two or more together, may also find a useful application in other types of sheet-separating or sheet-conveying suction devices differing from the types described above.

While the invention has been illustrated and described as embodied in a sheet-separating and/or conveying suction device, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A sheet-separating and conveying suction device, comprising a housing; a first sleeve positioned within said housing and secured thereto; a first suction piston having a hollow piston rod carrying a suction nozzle and being reciprocally movable upwardly and downwardly in said first sleeve between an initial and end position; a spring biasing said piston to the initial position in said housing, in which said suction nozzle is remote from a sheet to be sucked from a stack, said housing having a peripheral wall and an end wall, said first suction piston with said hollow piston rod and said peripheral wall and said first sleeve defining one cylinder chamber in said housing while said peripheral wall and said end wall defining another cylinder chamber in said housing; throttle means for connecting said one cylinder chamber and said another cylinder chamber with each other; and braking means for retarding the movement of said first suction piston towards its initial position, said braking means including an additional suction piston having a piston rod and cooperating with said first suction piston and an additional sleeve positioned in said housing and secured thereto, said additional suction piston being slidably movable in said additional sleeve between said end wall and said first suction piston, the piston rod of said additional piston and said additional sleeve defining a first intermediate cylinder chamber while the piston rod of said additional piston and said peripheral wall defining a second intermediate cylinder chamber, said throttle means connecting said first intermediate cylinder chamber with said another cylinder chamber and said second intermediate cylinder chamber, the piston rod of said first suction piston having a bore which opens into said second intermediate cylinder chamber.

2. The device as defined in claim 1, wherein said first sleeve and said additional sleeve are secured to said housing by screws.

3. The device as defined in claim 1, wherein said throttle means includes a first throttle which is formed by an annular gap provided between said peripheral wall of said housing and a periphery of said additional suction piston, said first throttle connecting said first intermediate cylinder chamber with said another cylinder chamber, said additional sleeve having a supporting surface, said first throttle being closable when said additional suction piston abuts against said supporting surface.

4. The device as defined in claim 3, wherein said throttle means includes a second throttle which is formed by a through bore in said additional sleeve, said second throttle connecting said first intermediate cylinder chamber with said second intermediate cylinder chamber.

5. The device as defined in claim 4, further including stops on said end wall, said additional suction piston abutting against said stops in said initial position of said first suction piston.

* * * * *